United States Patent [19]

Leer

[11] Patent Number: 4,543,584

[45] Date of Patent: Sep. 24, 1985

[54] COLLAPSIBLE MAGNETIC ANTENNA MOUNT

[75] Inventor: Stuart D. Leer, Dewitt, N.Y.

[73] Assignee: General Electric Company, Portsmouth, Va.

[21] Appl. No.: 486,119

[22] Filed: Apr. 18, 1983

[51] Int. Cl.[4] ..... H01Q 1/08

[52] U.S. Cl. ..... 343/881; 343/715; 248/537; 248/539

[58] Field of Search ..... 343/878–883, 343/713, 715, 900; 248/537, 539, 528, 166, 157, 163, 206.5

[56] References Cited

U.S. PATENT DOCUMENTS

| | | | |
|---|---|---|---|
| 2,522,223 | 9/1950 | Hardin et al. | 248/528 |
| 2,698,726 | 1/1955 | Howe | 248/528 |
| 3,034,754 | 5/1962 | Trindl | 248/158 |
| 3,082,982 | 3/1963 | Moskowitz | 248/537 |

FOREIGN PATENT DOCUMENTS

| | | | |
|---|---|---|---|
| 145478 | 4/1936 | Fed. Rep. of Germany | 248/528 |

*Primary Examiner*—Eli Lieberman
*Assistant Examiner*—Michael C. Wimer

[57] ABSTRACT

A collapsible antenna mount includes relatively movable arms pivotally connected to a support means such that the arms can be moved between collapsed positions adjacent each other and deployed positions in which the distal portions of the arms are spaced-apart. In the collapsed configuration, the antenna mount occupies a minimum amount of space for storage. In the deployed position, magnets located in the distal arm portions and the support means provide rigid support for the antenna mount on a car roof or the like.

6 Claims, 7 Drawing Figures

COLLAPSIBLE MAGNETIC ANTENNA MOUNT

FIELD OF THE INVENTION

This invention relates in general to antenna mounts and, more particularly, to a collapsible antenna mount which requires a minimum amount of space for its storage. This antenna mount is magnetically attachable to a metallic surface such as a car roof. The mount includes a plurality of relatively movable arms which can be deployed in space relation or, alternately, retracted to a compact closed position adjacent each other. The base, with its arms deployed, can hold an antenna mast upright and can withstand a substantial wind force directed frontally thereat.

BACKGROUND OF THE INVENTION

U.S. Pat. No. 4,293,860 discloses a mount for an antenna mast comprised of a non-collapsible base member which, in horizontal cross section, is substantially cylindrical. This mount employs a conical top and has a magnet disposed within the base member. Mounts of this type, while providing a substantially rigid and aerodynamic mount for positioning an antenna mast in a substantially rigid vertical position, are not easily stored due to the substantial volume occupied by the base member.

In applications where an antenna mount is to be stored within a case which can, for instance, also house a radio transceiver, it is desirable that the antenna mount be as small as possible. Heretofore, it has not been possible to reduce the base size substantially since a relatively broad base area is required to provide secure mounting against wind forces acting on the antenna during deployment on the roof of a car or the like.

SUMMARY OF THE INVENTION

Accordingly, it is an object of the present invention to provide an antenna mount which requires a minimum volume for storage and, accordingly, permits a radio, such as a citizens band transceiver, and antenna to be stored in combination within a single package of minimum exterior dimension.

Another object of this invention is to provide an antenna mount characterized by an aerodynamic structure which rigidly positions an antenna mast in a substantially vertical posture.

Briefly stated, in carrying out the invention in one form, a collapsible antenna mount includes a plurality of arms each having proximate and distal ends. Interconnecting means pivotally interconnects the arms at their proximate ends, the interconnecting means permitting relative pivotal movement of the elongated arms between a first collapsed configuration in which the distal ends of adjacent arms are in proximity and a deployed configuration in which the distal ends of adjacent arms are spaced apart from each other to provide a plurality of spaced apart mounting points. The mount further includes support means providing a mounting point adjacent the proximate ends of the arms. In a preferred form of the invention, magnets are provided at the mounting points to enable the antenna mount to be mounted on a metallic surface such as an automobile roof. The mounting points in the deployed configuration are substantially disposed in a plane, and the support means supports a rod antenna in an upright position substantially normal to the plane of the mounting points. By one embodiment of the invention, the support means comprises a separate member to which each of the arms is connected by the interconnecting means. More particularly, the support means comprises a base plate and a support shaft or journal fixed thereto on an axis substantially normal to the plane of the mounting points, and each of the arms includes annular bearing means interconnected to the journal for permitting pivotal movement of the arm about the support journal.

By a further aspect of the invention, the plurality of elongated arms comprises a pair of arms, and the interconnecting means includes means for establishing and limiting the included angle between the pair of arms in the deployed configuration. The support means preferably has an at least slightly elongated configuration in substantially the plane of the mounting points, the support means extending away from the distal ends of the arms along an axis substantially bisecting the included angle between the arms in the deployed configuration. By a still further aspect of the invention, the support means includes air deflection means at the end thereof remote from the distal ends of the arms and concave bearing support means contacting and supporting the annular bearing means mounted on the support journal.

In a preferred embodiment of the invention, the support means and one of the elongated arms comprise an integral member, and the other arm is pivotally supported at its proximate end by the integral support member. The means for establishing and limiting the included angle between the pair of arms includes either detent or pin means between the arms.

BRIEF DESCRIPTION OF THE DRAWINGS

The inventive idea disclosed herein is capable of receiving a variety of mechanical expressions; the accompanying drawings are included herein for the purpose of illustrating particular embodiments of this inventive idea and are not intended to be limiting on the scope thereof. In these drawings.

DETAILED DESCRIPTION OF THE DRAWINGS

Figure 1:
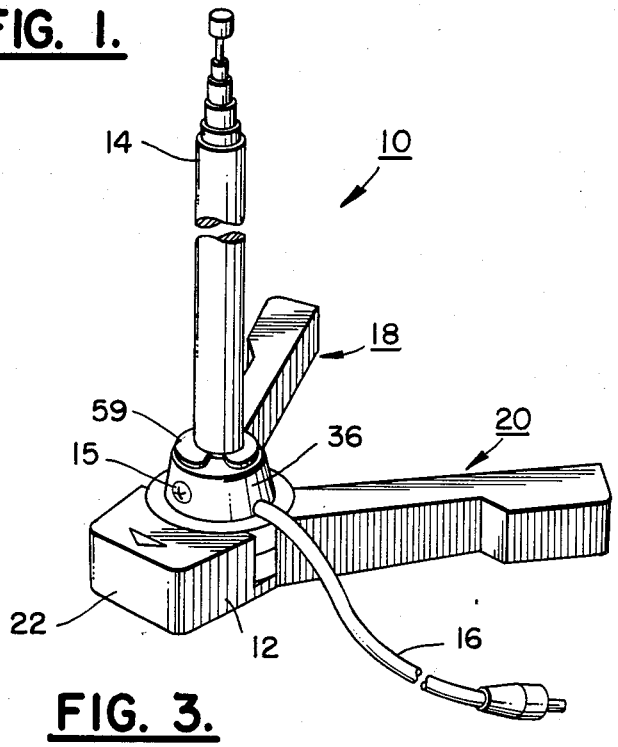
FIG. 1 is an illustration of a collapsible antenna mount constructed in accordance with the present invention, the mount being shown in its deployed configuration.
Figure 3:
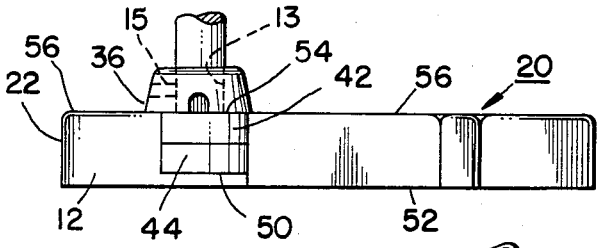
FIG. 3 is a side view of the antenna mount of FIG. 1.

Referring now to FIG. 1, one embodiment of a collapsible antenna mount constructed in accordance with the present invention is shown, the mount generally designated by the numeral 10. This mount includes a base member 12 and a retractable rod antenna mast 14 which can be mounted in a support shaft 36 on the base member 12. The lower portion of the antenna mast can for instance be cylindrical and fixedly positioned within a mating cylindrical recess 13 disposed within the shaft 36 as shown by FIG. 3. A screw 15 or other fastener can in one embodiment be used to secure the antenna mast 14 to the base member 12. An antenna wire 16 can advantageously couple the antenna mast 14 and its coil 105 (FIG. 5) to a signal processing means such as a radio frequency receiver or transceiver not shown.

Figure 2:
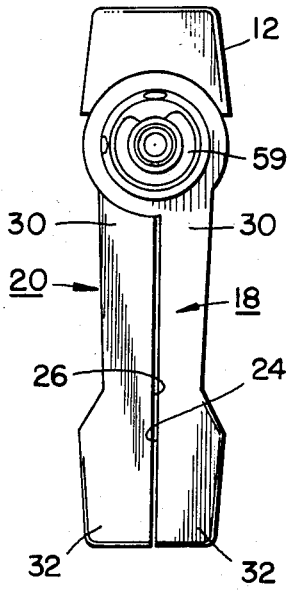
FIG. 2 is a top view of the collapsible antenna mount of FIG. 1 in its collapsed configuration.
Figure 4:
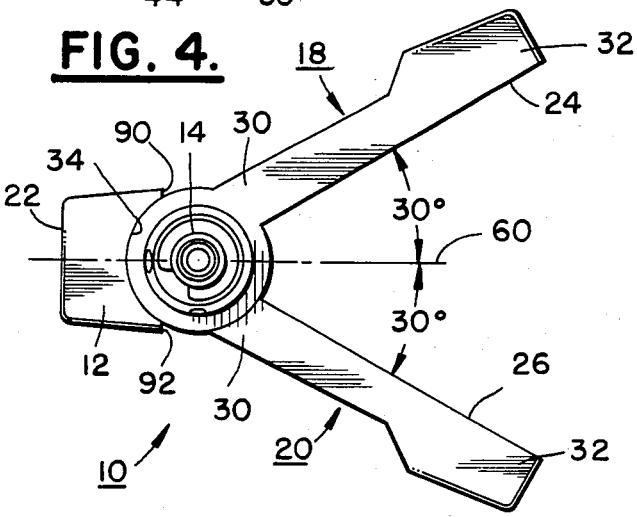
FIG. 4 is a top view of the antenna mount of FIG. 1 in its deployed position.

As shown by FIGS. 1, 2 and 4, first and second elongated support arms 18 and 20 are pivotally connected to the base member 12 by suitable interconnecting means described below. Each of the elongated legs 18 and 20 includes a proximate end portion 30 adjacent the base member 12 and a distal end portion 32 at the other end remote from the base member 12. The arms 18 and 20 in combination with the base member 12 provide the collapsible antenna mount 10 with a stable planar three point stance at the base member 12 and the distal ends 32 of the arms 18 and 20. The arms 18 and 20 may be pivoted relative to each other between a deployed position, illustrated by FIGS. 1 and 4, and a collapsed position, illustrated by FIGS. 2 and 5. The base member 12 includes a front deflector 22 which can advantageously have a blocklike configuration and slightly rounded corners to deflect or redirect wind outwardly around the antenna mount. The front deflector 22 can also advantageously be weighted to more fixedly anchor the support member 12.

The base member 12 and the arms 18 and 20 of the antenna mount 10 can be constructed of any suitable plastic material and may be mounted on any flat surface by suitable mounting means located in the distal ends 32 of the arms 18 and 20 and in the base member 12. In particular, as will be described below, the collapsible antenna mount employs magnets to magnetically attach the collapsible antenna mount to a metallic surface such as a automobile roof.

Referring now to FIG. 2, a top view of a collapsible antenna mount in accordance with the present invention is shown in collapsed position with the support arms 18 and 20 pivotally retracted so that their inner surfaces 24 and 26, respectively, and their distal ends 32 are adjacent each other. So positioned, the collapsible antenna mount takes on a substantially in-line form and, accordingly, is storable within a minimum volume.

Referring now to FIGS. 1, 3, 4, and 6, it is seen that the front deflector 22 of the base member 12 has a partially cylindrical inner surface 34. A central shaft or journal 36 having a substantially cylindrical outer bearing surface is mounted on a substantially flat planar base plate 40. The journal 36 projects upwardly from the base plate 40 on an axis normal thereto and at its upper end supports the antenna mast 14 as described above. The journal 36 is also disposed along an axis normal to the mounting plane determined by the mounting points in the arms 18 and 20 and the support member 12. The support arms 18 and 20 are each attached at their proximate ends 30 to the central shaft by bearing members comprising loops or annular rings 42 and 44 appended to arms 18 and 20, respectively. The rings 42 and 44 have interior diameters slightly greater than the exterior diameter of the support shaft 36 and exterior diameters slightly less than the diameter of an interior surface 34 of the front deflector 22. The rings 42 and 44 thus fit over and are supported by the central shaft 36 and are guided and further supported by the curvilinear interior surface 34 of the front deflector. The journal 36 and the mating rings 42 and 44 permit the elongated arms 18 and 20 to be pivoted relative to each other about the axis of the journal 36 between the collapsed configuration of FIGS. 2 and 5 and the deployed configuration of FIGS. 1, 3, 4, and 6.

The rings 42 and 44 each have a vertical dimension which is approximately one half the total height of the cylindrical portion of support journal 36 and, more particularly, are designed to be stacked as shown upon the cylindrical shaft 36 with the thickness of the base plate 40, combined with the total thickness of the stacked rings 42 and 44, being approximately equal to the total height of the base member 12. As illustrated in FIG. 3, the lower surface 50 of the bearing member 44 of the arm 20 is not flush with the lower surface 52 of the arm 20 but, instead, is recessed from that surface by a distance equal to the thickness of the base plate 40. The upper surface 54 of the upper loop or cylindrical ring 42, however, is flush with the upper surface 56 of the base member 12 and the upper surface 58 of support arm 20 (and 18). In the disclosed embodiment, the lower plate 40 provides a stop or locking surface for mounting the annular loops 42 and 44 on the central shaft 36. The loops or rings 42 and 44 are held on the shaft 36 at the upper end thereof by means of a removable C-clip 59.

Referring now to FIG. 4, a top view of a collapsible mount 10 is shown with support arms 18 and 20 in deployed position. The support arms 18 and 20 in their deployed positions are each pivotally deployed at an angle of 30° to a central axis 60 extending through the center line of the front deflector 22. The front deflector also has a slightly elongated configuration along the axis 60 in a direction extending away from the distal ends 32 of the arms 18 and 20. When mounted, the deflector 22 faces forward into the wind with the arms 18 and 20 trailing at angles diverging 30° from the line 60 of travel. Such deployment provides a minimal resistance to wind, while simultaneously providing tripod type support for the antenna mast to position it in a substantially rigid and vertical manner when mounting means are provided at the distal ends 32 of the arms 18 and 20 and at the support member 12.

Figure 5:
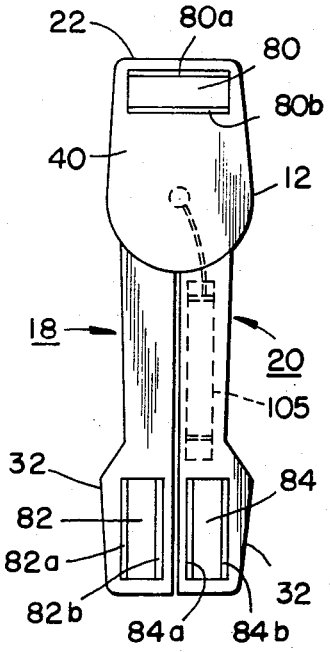
FIG. 5 is a bottom view of the antenna mount of FIG. 1 in its collapsed position.

Referring now to FIG. 5, an underview of an antenna mast 10 in accordance with a preferred form of the present invention is illustrated. More particularly, magnets 80, 82 and 84 are deployed in the underside of the forward portion of the front deflector 22 and in the underside of the distal end 32 of each arm 18 and 20, respectively. As shown in more detail in FIG. 5, the magnets 80, 82 ad 84 can advantageously be side-shielded by metal plates 80*a*, 80*b*, 82*a*, 82*b*, 84*a*, 84*b* to concentrate the magnetic field of these magnets in a desired direction and thereby concentrate the attractive force of these magnets in a vertical direction. By providing three magnets as shown, a plurality of spaced-apart mounting points is provided for establishing a mounting plane normal to the axis of the support shaft or journal 36. Moreover, the three-point mount assures the formation of a mounting plane on a surface, such as an automobile roof, which may not itself be a flat surface. An antenna coil 105, connected to the antenna mast 14 to complete the electrical circuit between the mast 14 and the antenna wire 16, is located within the hollow interior of the leg 20.

Figure 6:
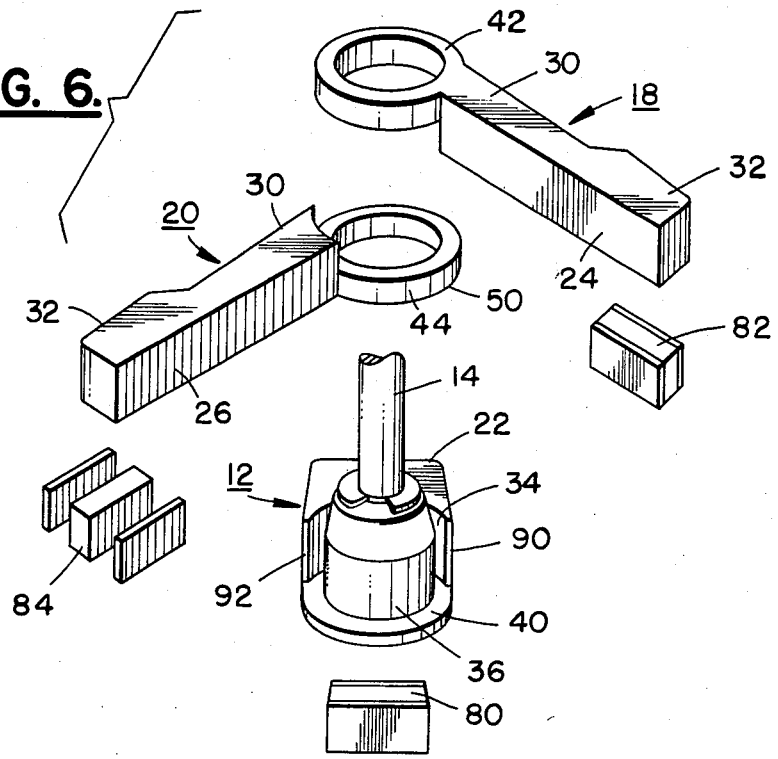
FIG. 6 is an exploded parts view of the antenna mount of FIG. 1.

Referring now to FIG. 6, the embodiment of FIGS. 1–5 is shown in exploded form. As described above, the central shaft 36 has a substantially cylindrical exterior surface and the front deflector 22 has a substantially concave cylindrical inner surface 34 which in combintion form a guide or journal for the substantially cylindrical bearing member rings 42 and 44. Accordingly, the support arms 18 and 20 can be rotated in a pivotal manner about the cylindrical shaft 36. In the illustrated embodiment, the outer edges or extremities 90 and 92 of the cylindrical inner surface 34 of the deflector 22 act in this embodiment as stops for the proximate portions 30 of the arms 18 and 20. More particularly, the support arms 18 and 20 can be relatively pivoted outwardly until the outer surfaces of the support arms contact the rear extremities 90 and 92 of the front deflector 22. In their deployed configuration, the arms 18 and 20 thus engage the outer extremities 90 and 92 of the front deflector 22 to provide a maximum angle of approximately 60° between the opposed interior surfaces 24 and 26 of the support arms 18 and 20. Moreover, detents not shown can be included on the opposed upper and lower surfaces of the bearing rings 44 and 42, respectively, to maintain the legs 18 and 20 relative to one another in either the deployed or the collapsed configurations. It is preferred that positioning be primarily provided by the detents with the extremities 90 and 92 acting as stops of last resort.

Figure 7:
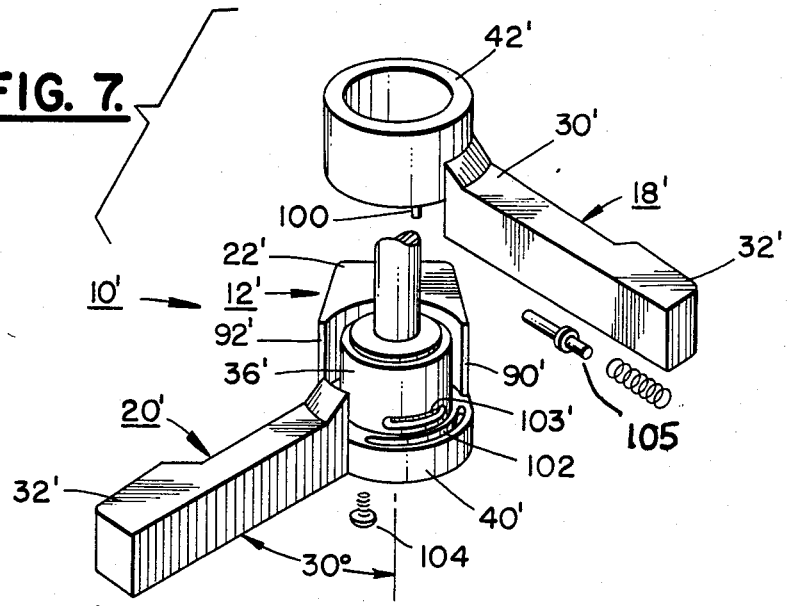
FIG. 7 is an exploded parts view similar to FIG. 6 of a preferred embodiment of the invention having only one movable arm.

A second particularly preferred embodiment of the invention is illustrated by FIG. 7. In this embodiment, an elongated leg 20' is formed integrally with a base member 12', the leg 20' being disposed relative to the elongated dimension of the base member 12' such that a fixed angle of approximately 30° is formed therebetween. The bearing member 42' of the other leg 18' is mounted on a shaft 36' extending upwardly from a base plate 40'. The relative pivotal movement of the two legs 18' and 20' is provided through movement of only the movable leg 18' between a collapsed configuration in which the distal ends 32' are adjacent each other and a deployed configuration in which the distal ends are spaced apart to an extent that an included angle of approximately 60° is provided between the legs 18' and 20' along an axis 60' that bisects the angle between the legs 18' and 20'. As in the embodiment of FIGS. 1–6, maximum movement of the leg 18' is limited by a connection between the bearing member 42' and the base plate 40'. More particularly, a boss 100 depending from the bearing member 42' rides in a slot 102 in the base plate 40', contact between the boss 100 and opposite ends of the slot 102 establishing the collapsed and deployed configurations of the antenna mount 10'. A screw 104 extends through the slot 102 into a tapped opening in the boss 100, the head of the screw 104 being larger than the width of the slot 102 to hold the parts in their assembled positions and prevent undesired removal of the bearing members 42' from the shaft 36'. The shaft 36' includes a slot 103' for receiving a spring loaded detent pin 105 mounted in leg 18'. The slot 103 is relatively deeper at its opposite ends to hold the legs in their collapsed and deployed configurations.

It will be appreciated that the present invention provides a practical, cost-effective and efficient collapsible antenna mount which is readily stored in a minimal space. The collapsible antenna mount of the present invention is particularly attractive because it provides for rigid, tripod type support for vertically positioning an antenna and can be collapsed and stored within a case having minimal exterior dimension.

Although two embodiments of collapsible antenna mounts constructed in accordance with the present invention have been described in detail with reference to FIGS. 1 through 7, it is apparent that the collapsible antenna mount of the present invention can be fabricated from a number of substantially similar parts and can be used in combination with a number of substantially similar antennas, including those which are pivotally or swivelly mounted or attached to the collapsible mount. Additionally, while the present invention has been described in its preferred form with a certain degree of particularity, it is understood that the present disclosure of the preferred embodiment is made by way of example and that modifications in the details of construction may be resorted to without departing from the true spirit and scope of this invention. For example, more than two elongated legs may be used if desired, particularly if the mount is to be used on a surface known to be flat. Under certain circumstances, it may be desirable to replace the magnets with alternative mounting means. Moreover, it may be desired to replace the support member with a third arm which can be deployed in a forward direction relative to the two trailing arms. It is therefore intended that the patent shall cover by suitable expression in the appended claims whatever features of patentable novelty exist in the invention disclosed.

What is claimed as new and is desired to obtain by Letters Patent is:

1. A collapsible antenna mount comprising:

support means, a pair of elongated arms each having proximate and distal ends, each of said elongated arms being supported at its proximate end by said support means, interconnecting means at least partially including said support means pivotally interconnecting said elongated arms at the proximate ends thereof, said interconnecting means permitting relative pivotal movement of said elongated arms between a collapsed configuration in which the distal ends of said arms are in proximity and a deployed configuration in which the distal ends of said arms are spaced-apart from each other, said interconnecting means further including means for establishing and limiting the included angle between said pair of arms in said deployed configuration, said support means providing a mounting point adjacent the proximate ends of said elongated arms and each of said elongated arms providing a mounting point adjacent the distal end thereof, and a plurality of magnetic means each located at a respective one of said mounting points for magnetically attaching the antenna mount to a metallic surface, said support means further comprising means for supporting a rod antenna in an upright position substantially normal to the plane established by said mounting points, and said support means having an at least slightly elongated configuration in substantially the plane established by said mounting points, said elongated configuration extending away from the distal ends of said elongated arms along an axis substantially bisecting the included angle between said arms in said deployed configuration, and said elongated configuration including air deflection means at the end thereof remote from the distal ends of said arms.

2. A collapsible antenna mount as defined by claim 1, in which said pair of elongated arms comprises a fixed arm and a movable arm, said support member and said fixed arm comprising an integral member and said movable arm being pivotally supported at its proximate end by said support means.

3. A collapsible antenna mount as defined by claim 2 in which said support means comprises a base plate and a support journal fixed thereto on an axis substantially normal to the plane of said mounting points, said movable arm including at the proximate end thereof an annular bearing member mounted on said support journal for permitting pivotal movement of said movable arm about said support journal.

4. A collapsible antenna mount as defined by claim 3 in which said support means further includes concave bearing support means contacting and supporting the outer surfaces of said annular bearing member mounted on said support journal.

5. A collapsible antenna mount as defined by claim 4 further comprising a connection between said bearing member and said base plate for establishing and limiting the included angle between said fixed and movable arms in said deployed configuration.

6. A collapsible antenna mount as defined by claim 5 further comprising detent means for holding said fixed and movable arms in said collapsed and deployed configurations.

* * * * *